US011466453B2

(12) United States Patent
Lehane et al.

(10) Patent No.: US 11,466,453 B2
(45) Date of Patent: Oct. 11, 2022

(54) WALLBOARD PUNCH ASSEMBLY WITH STRIPPER BUSHINGS

(71) Applicant: United States Gypsum Company, Chicago, IL (US)

(72) Inventors: James J. Lehane, McHenry, IL (US); Peder John Gulbrandsen, Aurora, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 536 days.

(21) Appl. No.: 14/604,421

(22) Filed: Jan. 23, 2015

(65) Prior Publication Data

US 2016/0215499 A1 Jul. 28, 2016

(51) Int. Cl.
*E04B 9/04* (2006.01)
*B26F 1/02* (2006.01)
(Continued)

(52) U.S. Cl.
CPC ..... *E04B 9/0464* (2013.01); *B26F 1/02* (2013.01); *B28B 1/48* (2013.01); *E04B 1/82* (2013.01);
(Continued)

(58) Field of Classification Search
CPC ..... B26F 1/02; B26F 1/40; B26F 1/14; B26D 2007/189; B26D 2007/1881
(Continued)

(56) References Cited

U.S. PATENT DOCUMENTS 1,808,500 A 6/1931 Holny
2,191,836 A * 2/1940 Stromberg ..... B26D 7/1818 83/124
(Continued)

FOREIGN PATENT DOCUMENTS

JP 2007 030127 A 2/2007
KR 100899072 B1 5/2009
KR 2020110006090 6/2011

OTHER PUBLICATIONS

Chinese Office Action from corresponding Chinese Patent Application No. 201680004708.1, dated Oct. 8, 2018.
(Continued)

*Primary Examiner* — Evan H MacFarlane
*Assistant Examiner* — Fernando A Ayala
(74) *Attorney, Agent, or Firm* — Greer, Bums & Crain Ltd.; Phillip T. Petti; Pradip Sahu

(57) ABSTRACT

A punch assembly for creating clean holes in a wallboard sheet having at least one surface with a face paper layer. The punch assembly includes a frame having a lower assembly configured to support the wallboard sheet, a plate on an upper frame assembly being reciprocable relative to the at least one surface of the wallboard sheet, at least one stripper bushing connected to the plate, where the at least one stripper bushing including a hole and a piercing edge, and at least one punch configured to move through the hole in the at least one stripper bushing. In operation, the plate is moved against the at least one surface of the wallboard sheet so that the piercing edge of the at least one stripper bushing contacts the face paper layer and at least partially cuts the face paper layer prior to the at least one punch moving through the wallboard sheet to form at least one clean hole in the wallboard sheet.

20 Claims, 6 Drawing Sheets

(51) Int. Cl.
*B28B 1/48* (2006.01)
*E04B 1/82* (2006.01)
*B26F 1/40* (2006.01)

(52) U.S. Cl.
CPC ..... *B26F 1/40* (2013.01); *E04B 2001/8245* (2013.01)

(58) Field of Classification Search
USPC .... 83/39, 123, 125, 126, 128, 129, 143, 144
See application file for complete search history.

(56) References Cited

U.S. PATENT DOCUMENTS 2,228,162 A 1/1941 Benham et al.
2,272,703 A 2/1942 Haegele
2,290,557 A 7/1942 Heath
2,315,256 A 3/1943 Haegele et al.
2,323,564 A 7/1943 Page
2,615,525 A 10/1952 Berner
2,667,925 A 2/1954 Dalphone
2,686,461 A 8/1954 Heritage et al.
2,699,830 A * 1/1955 Hodge ..... B21D 28/34 83/140
3,070,404 A * 12/1962 Moyer ..... B21D 37/10 384/30
3,465,634 A * 9/1969 Blais ..... B26D 7/1818 225/96
3,779,113 A * 12/1973 Jestin ..... B21D 28/24 83/140
4,196,944 A * 4/1980 Simatovich ..... B21D 37/12 384/49
4,246,815 A * 1/1981 Hugo ..... B21D 28/34 83/139
4,425,829 A * 1/1984 Kranik ..... H05K 3/005 234/33
4,558,619 A * 12/1985 Caumont ..... B26F 1/14 83/128
4,872,381 A * 10/1989 Stroms ..... B21D 31/02 83/169
5,079,983 A * 1/1992 Bruhn ..... B21D 28/002 227/131
5,233,895 A * 8/1993 Coneski ..... B26D 5/08 234/107
5,382,404 A * 1/1995 Kogame ..... B26D 3/085 264/145
5,600,992 A * 2/1997 Kanazawa ..... B21D 19/08 72/352
5,884,546 A * 3/1999 Johnson ..... B21D 28/34 83/140
6,006,636 A * 12/1999 Baldwin ..... B26F 1/04 83/13
6,276,247 B1 * 8/2001 Helda ..... B21D 28/34 83/684
6,311,597 B1 * 11/2001 Schroth ..... B21D 37/12 83/531
6,451,241 B1 9/2002 Ohliger et al.
7,182,899 B2 * 2/2007 Tanii ..... H01G 4/30 156/261
7,194,941 B2 3/2007 Vogl
7,578,224 B2 * 8/2009 Halamoda ..... B21D 28/34 83/687
2004/0123640 A1 * 7/2004 Rooney, Jr. ..... B21D 45/006 72/456
2004/0168560 A1 * 9/2004 Halamoda ..... B26D 7/1863 83/687
2011/0067538 A1 * 3/2011 Greenleaf ..... B21D 28/26 83/143
2011/0100172 A1 5/2011 Takeshita et al.
2011/0107889 A1 * 5/2011 Lee ..... B26D 7/1818 83/168
2014/0260438 A1 9/2014 Matsumura

OTHER PUBLICATIONS

Korean Office Action from corresponding Korean Patent Application No. 10-2017-7021242 dated Apr. 9, 2020 (5 pages).
Australian Office Action from corresponding Australian Patent Application No. 2016209592 dated Apr. 2, 2020 (3 pages).

* cited by examiner

WALLBOARD PUNCH ASSEMBLY WITH STRIPPER BUSHINGS

BACKGROUND

The present application relates generally to wallboard manufacturing machines used in producing wallboard, and more particularly to such machines used for punching or stamping holes in wallboard.

Wallboard is cut into various sizes and shapes to correspond to the size and shape of a surface or wall on which the wallboard is being mounted. In some instances, patterns of holes or other openings are made in wallboard panels for obtaining enhanced acoustical properties or for other purposes. In an example, a punch press is used to form the holes. Conventional wallboard punch presses typically include a die bushing plate and a stripper plate, where a sheet or panel of wallboard is positioned between the die bushing plate and the stripper plate. The die bushing plate supports the wallboard sheet and includes a plurality of holes that are aligned with the locations of the holes to be formed in the wallboard. The stripper plate is positioned on top of the wallboard sheet and includes holes that are aligned with the hole locations in the wallboard and the holes in the die bushing plate. The punch press includes a plurality of typically cylindrical punches that are aligned with the holes in the stripper plate. The punches, which may be simultaneously, sequentially or individually moved, are driven downwardly through the holes in the stripper plate, through the wallboard and at least partially through the holes in the die bushing plate, and then return to the initial position spaced from the wallboard sheet. The result of the punching operation is that the wallboard sheet includes one or more holes having a shape that corresponds to the shape of the punches.

Wallboard commonly has paper facing sheets on each side of the gypsum core to provide strength and rigidity to the wallboard. In a typical punching operation, portions of the paper facing sheet on the top surface or surface initially contacted by the punches extends into the respective hole openings because the bottom surfaces of the punches are flat and form 90° corners with the shaft or sidewall of the punches. As a result of the punching process, portions or fragments of the facing paper extend into the holes leave an unclean look that often requires the extending paper portions to be manually trimmed after completion of the punching process. Furthermore, punches having bottom surfaces with teeth configured to pierce the facing paper before the punches move through the wallboard sheet do not remedy the above problem.

Accordingly, there is a need for a wallboard punching machine that cleanly punches through the face paper on both sides of a wallboard sheet.

SUMMARY

The present disclosure provides a punch assembly that includes one or more stripper bushings each having a piercing edge and a plurality of punches configured to move through the stripper bushings and all layers of a wallboard sheet or panel. The piercing edge on each of the stripper bushings is moved against the wallboard sheet prior to the punches moving through the stripper bushings and the wallboard sheet to pre-cut openings in the upper face paper layer on the wallboard sheet and provide clean upper and lower openings associated with each of the holes punched in the wallboard sheet. The resultant clean holes enhance the aesthetic appearance and acoustic properties of the wallboard sheet.

In an embodiment, a punch assembly for creating clean holes in a wallboard sheet having at least one surface with a face paper layer is provided and includes a frame having a lower assembly configured to support the wallboard sheet where a plate on an upper frame assembly being reciprocable relative to the at least one surface of the wallboard sheet at least one stripper bushing is connected to the plate. Included in the at least one stripper bushing are a hole and a piercing edge and at least one punch configured to move through the hole in the at least one stripper bushing. In operation, the plate is moved against the at least one surface of the wallboard sheet so that the piercing edge of the at least one stripper bushing contacts the face paper layer and at least partially cuts the face paper layer prior to the at least one punch moving through the wallboard sheet to form at least one clean hole in the wallboard sheet.

In another embodiment, a punch assembly for creating clean holes in a wallboard sheet having opposing upper and lower face paper layers is provided and includes a frame, a die plate including a plurality of die bushings configured for supporting the wallboard sheet, each of the die bushings including a hole. A stripper plate is vertically reciprocable against the upper surface of the wallboard sheet and includes a plurality of stripper bushings that are connected to the stripper plate. Each of the stripper bushings includes a hole and a piercing edge. A plurality of punches are aligned with corresponding holes in the stripper bushings and the die bushings, and are configured for moving through the holes in the stripper bushings and the die bushings. In operation, the stripper plate is moved against the upper face paper layer of the wallboard sheet so that the piercing edges of each of the stripper bushings contact and at least partially cut the upper face paper layer prior to the punches moving through the holes in the stripper bushings, the wallboard sheet and at least partially into the holes in the die bushings to respectively form a plurality of clean holes in the wallboard sheet.

DETAILED DESCRIPTION

Figure 1A:
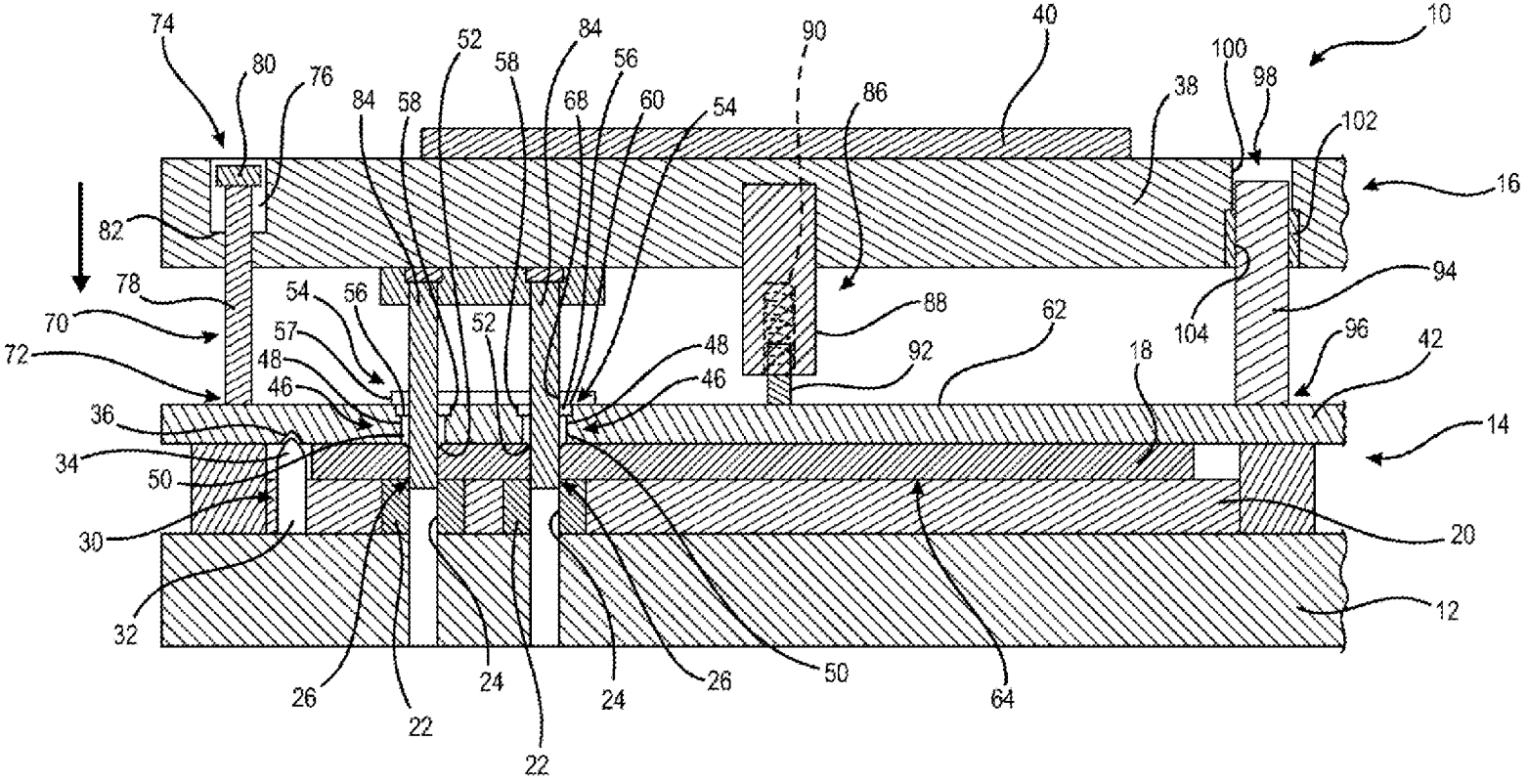
FIG. 1A is a fragmentary, partial section view of the present punch assembly where the upper assembly is in a first position relative to the lower assembly.

The present punch assembly forms one or more holes through a wallboard sheet in different patterns. A feature of the present assembly is that each hole is formed cleanly through the wallboard sheet with less face paper fragments and cracking at the hole openings.

Referring now to FIGS. 1A, 1B, 2A, 2B, 2C and 4, the punch assembly generally designated as reference number 10 includes a frame 12, a lower assembly 14 attached to the frame and an upper assembly 16 movably connected to the frame 12 where the upper assembly 16 reciprocates relative to the lower assembly 14 to punch or stamp holes in a wallboard sheet or panel 18 placed upon the lower assembly 14.

The lower assembly 14 includes a die plate 20 mounted to the frame 12 and at least one die bushing, and preferably, a plurality of die bushings 22 removably attached to the die plate 20. In the illustrated embodiment, the die plate 20 and die bushings 22 are made of a durable material such as steel. It should be appreciated that the die plate 20 and the die bushings 22 may be made out of any suitable material or combination of materials. Each of the die bushings 22 has an outer diameter and a through-hole 24 with a designated inner diameter. The die bushings 22 support the wallboard sheet 18 and form a bottom opening 26 of each hole 28 made in the wallboard sheet 18. During a punching or stamping operation, at least one pilot pin 30 is attached to and extends upwardly from the die plate 20 to help align and position the wallboard sheet 18 relative to the upper and lower assemblies 14, 16. As shown in FIG. 1A, the pilot pin 30 has a body 32 with a tapered top end 34 to facilitate the engagement of the pilot pin with an alignment recess or hole 36 in stripper plate 42.

The upper assembly 16 includes an upper member 38 attached to a hydraulic ram portion or ram 40 of the punch assembly 10 that is movably connected to the frame 12. Preferably, the ram 40 includes one or more hydraulic pistons (not shown) each attached to the upper assembly 16 that reciprocally move the upper assembly relative to the lower assembly 14 in upward and downward strokes. The stripper plate 42 is spaced from and positioned below the upper member 38. The stripper plate 42 is a generally rectangular plate made of steel or other suitable material that includes at least one, and preferably a plurality of holes 44 (FIGS. 2A-2C) arranged in a desired pattern. The holes 44 are configured to have a designated shape and inner diameter to each receive a stripper bushing 46. Each stripper bushing 46 has a cylindrical body 48 with a bottom end 50 having a piercing edge 52, and a top end 54 having a flange 56 integrally formed with the body 48, where the flange has an outer diameter that is greater than an outer diameter of the body. A bushing backing plate 57 (FIGS. 1A and 1B) is placed on top of the stripper bushings 46 to help hold these bushings in place during operation.

Figure 2C:
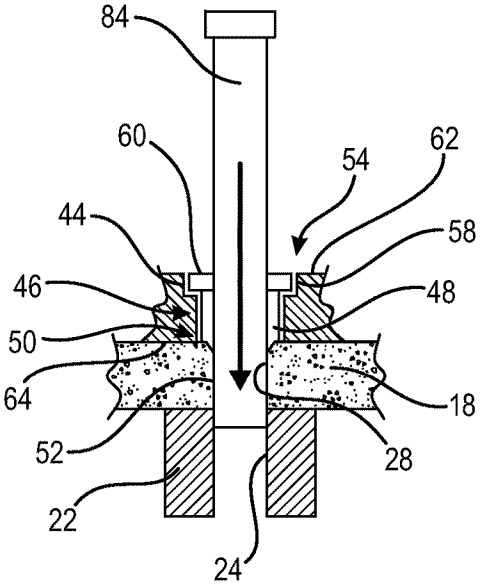
FIG. 2C is a fragmentary, side view of the punch of FIG. 2A where the punch is in a third position fully through the wallboard sheet.
Figure 2B:
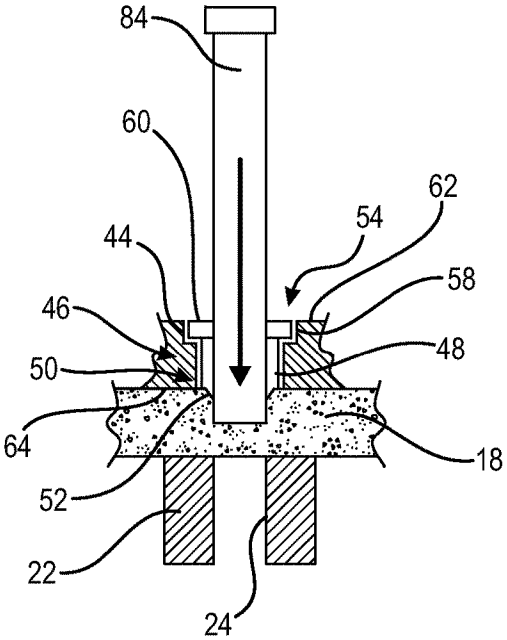
FIG. 2B is a fragmentary, side view of the punch of FIG. 2A where the punch is in a second position partially through the wallboard sheet.
Figure 2A:
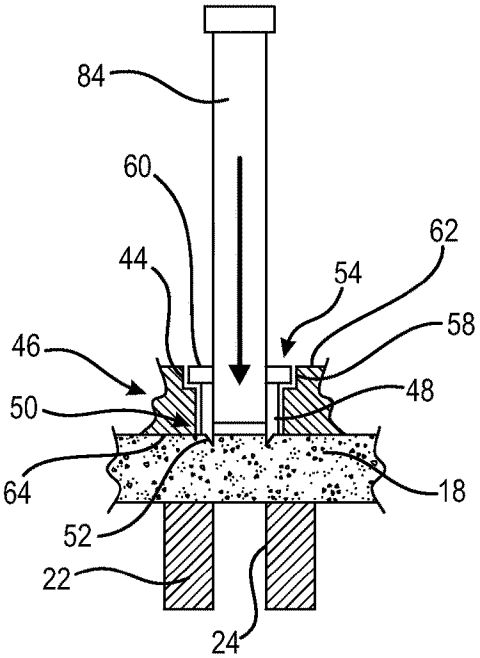
FIG. 2A is a fragmentary, side view of a punch of the punch assembly of FIG. 1 where the punch is in a first position above a wallboard sheet.
Figure 3A:
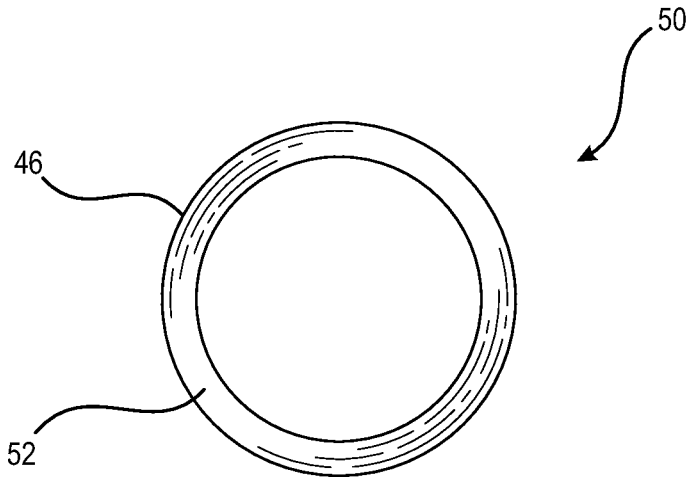
FIG. 3A is a bottom view of a stripper bushing having a continuous piercing edge.
Figure 3B:
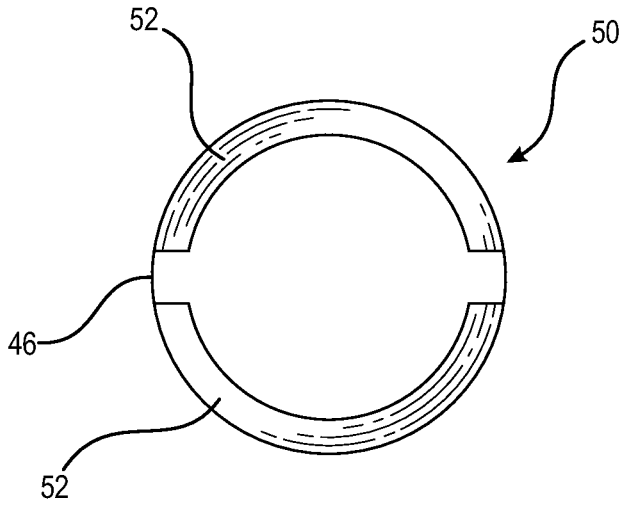
FIG. 3B is a bottom view of a stripper bushing having a non-continuous piercing edge.
Figure 4:
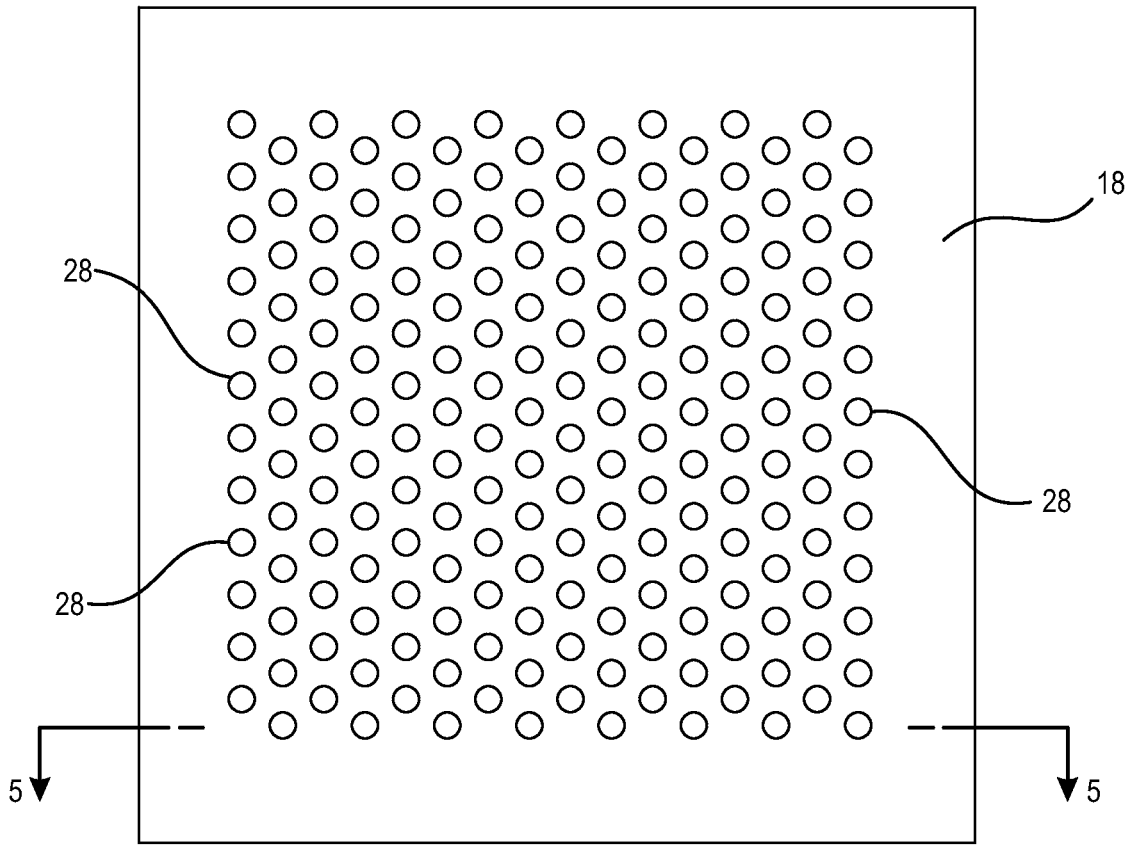
FIG. 4 is a top view of an embodiment of a wallboard sheet produced by the punch assembly of FIG. 1.
Figure 5:
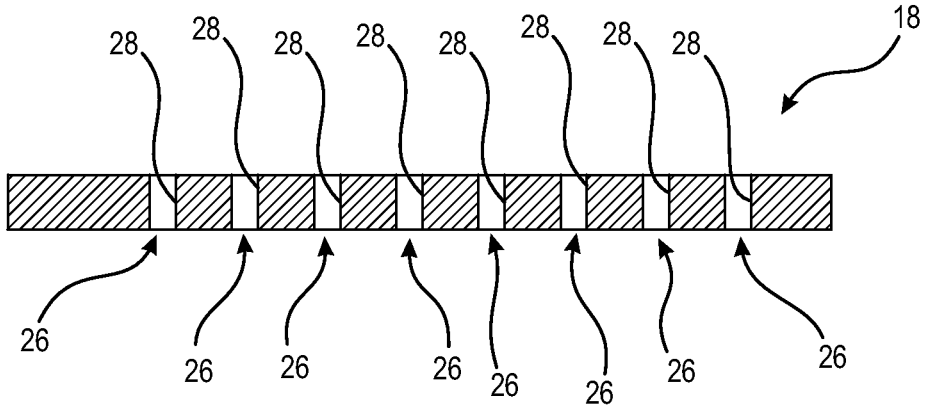
FIG. 5 is a cross section of the wallboard sheet of FIG. 4 taken along line 5-5 in FIG. 4 and in the direction generally indicated.
Figure 6:
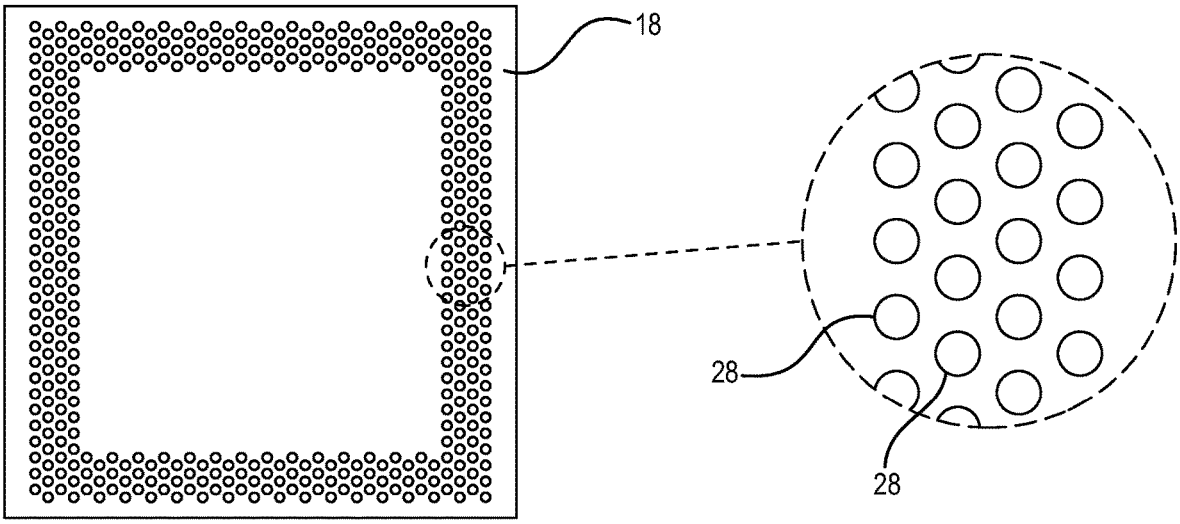
FIG. 6 is another embodiment of a wallboard sheet produced by the punch assembly of FIG. 1.

In one embodiment shown in FIGS. 2A and 3A, the piercing edge 52 is a single, continuous beveled, sharpened edge formed about the periphery of the bottom ends 50 of each of the stripper bushings 46. Alternatively in another embodiment, as shown in FIG. 3B, the piercing edge 52 is a non-continuous, beveled, sharpened edge having one or more segments or sections. Each of the holes 44 in the stripper plate has an upper end with a recessed portion 58 (FIGS. 2A-2C) including an outer diameter that is greater than the outer diameter of the respective hole 44 to enable each of the stripper bushings 46 to be seated in a corresponding hole 44 such that the top surfaces 60 of the stripper bushings 46 are flush with the top surface 62 of the stripper plate 42.

As shown in FIGS. 1A, 1B, 2A, 2B and 2C, the piercing edge 52 extends at least partially beyond the bottom surface 64 of the stripper plate 42 to engage the wallboard sheet 18 being punched or stamped by the punch assembly 10. The flat, rectangular backing plate 57 is made of steel or other suitable material is placed upon the stripper plate 42 and the stripper bushings 46, and includes holes 68 each having an inner diameter that corresponds with the inner diameter of the holes 44 in the stripper bushings 46. The backing plate 57 helps to hold and secure the stripper bushings 46 in the stripper plate 42 during operation of the punch assembly 10.

A plurality of supports, such as bolts 70, interconnect the upper member 38 with the stripper plate 42. Each support or bolt 70 includes a bottom end 72 attached to the stripper plate 42 and a top end 74 that is reciprocally movably positioned in a corresponding recess 76 formed in the upper member 38. Specifically, the top end 74 of each bolt 70 includes a body 78 and a head 80, where the head has an outer diameter that is greater than an outer diameter of the body as shown in FIG. 1A.

Additionally, a plurality of guide pins 94 further interconnect the upper member 38 and the stripper plate 42 where each guide pin includes a bottom end 96 fixedly attached to the stripper plate 42 and a top end 98 slidably connected to the upper member 38. The upper member 38 includes a plurality of holes 100 corresponding to the size and shape of the top ends 98 of the guide pins 94. A plurality of guide bushings 102 are each removably inserted in a respective one of the holes 100. Each guide bushing 102 includes an inner surface 104 having machined grooves that receive and hold a lubricant. The guide bushings 102 each define a through-holes 106 each having an inner diameter that is greater than the outer diameter of the guide pins 94 such that the guide pins reciprocally slide within the guide bushings 102. The guide pins 94 further support the connection between the upper member 38 and the stripper plate 42 and help to maintain the orientation of upper member 38 relative to the stripper plate 42 so that the punches 84 remain aligned with the corresponding holes in the stripper plate 42 and the die plate 20.

In operation, the ram 40 moves the upper assembly 16 downwardly against the wallboard sheet 18. Initially, the head 80 of each bolt 70 is positioned at the bottom ends 82 of the corresponding recess 76. When the stripper plate 42 of the upper assembly 16 engages the wallboard sheet 18, the ram 40 continues to move the upper member 38 downwardly to apply pressure on the stripper plate 42 and thereby the wallboard sheet 18. This pressure causes the head 80 of the each bolt 70 to move upwardly within the respective recesses 76.

Once the piercing edges 52 engage the wallboard sheet 18, the ram 40 retracts the upper assembly 16 upwardly away from the lower assembly 14. Also, the upper member 38 moves upwardly until the head 80 of each of the bolts 70 contacts the bottom ends 82 of the respective recesses 76, which causes the upper member 38 to pull upwardly on each bolt to simultaneously pull upwardly on the stripper plate 42 and move the stripper plate 42 away from the wallboard sheet 18.

Referring now to FIGS. 1A, 1B and 2A-2C, at least one and preferably a plurality of punching rods or punches 84 are attached to the upper member 38. In the illustrated embodiment, each of the punches 84 has a cylindrical cross-sectional shape but it should be appreciated that the punches 84 may each have the same shape or different shapes. Also, the punches 84 may have square-shaped cross-sectional shape or have any suitable cross-sectional shape. The punches 84 each have an outer diameter that is less than the respective inner diameters of the backing plate 57, stripper plate 42, the stripper bushings 46, the die plate 20 and the die bushings 22 so that the punches can move reciprocally through the through-holes 68 formed by the aligned holes in the backing plate 57, the stripper bushings 46, the stripper plate 42, the die plate 20 and the die bushings 22. Each punch 84 has a length that enables the punch to extend fully through the wallboard sheet 18 during each downward stroke of the upper assembly 16. It should be appreciated that the punches 84 may have any suitable length and may have a length that enables the punches to extend partially through or fully through a wallboard sheet 18.

Figure 1B:
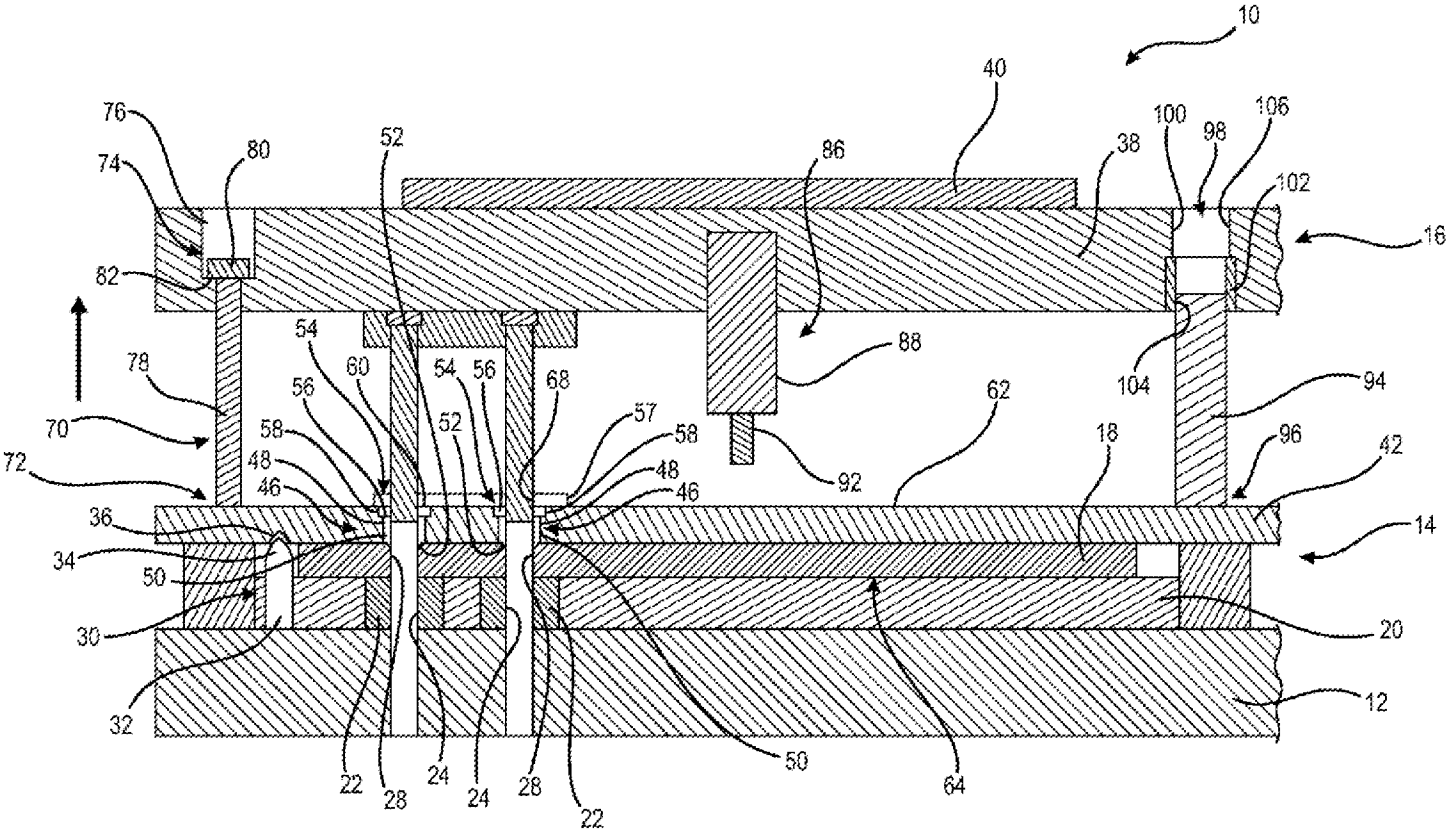
FIG. 1B is a fragmentary, partial section view of the present punch assembly where the upper assembly is in a second position relative to the lower assembly.

At least one biasing member 86 is attached to the upper member 38 and biases the stripper plate 42 against the wallboard sheet 18 until the ram 40 moves the upper member 38 from a first position or contact position shown in FIG. 1A to a second position or non-contact position shown in FIG. 1B. The biasing member 86 includes a housing 88 having at least one biasing device, such as coil spring 90, which biases a post 92 such that the post maintains contact and tension on the stripper plate 42. The post 92 is movably connected to the housing 88 and moves from a retracted position, where the post 92 is engaged with the stripper plate 42 (FIG. 1A), to a fully extended position, where the biasing member 86, and thereby the post 92, is moved away from and is not engaging the stripper plate 42. Specifically, the biasing member 86 biases the stripper plate 42 against the wallboard sheet 18 during a punching or stamping operation until the upper assembly 16 moves away from the lower assembly 14 and the punches 84 are spaced from or above the wallboard sheet 18.

Referring to FIGS. 1A, 2A, 2B and 2C, in operation, the upper assembly 16, and more specifically, the upper member 38 is in an upper, non-contact position relative to the lower assembly 14. In this position, the punches 84 are spaced from and above the wallboard sheet 18 to enable the wallboard sheet 18 to be placed in position on the die plate 20 and aligned by the pilot pin 30 or indexed or advanced to another punch position on the die plate 20. To punch or stamp one or more holes 28 in the wallboard sheet 18, the ram 40 moves the upper member 38, and thereby the stripper plate 42, downwardly toward the lower assembly 14.

As the stripper plate 42 engages the wallboard sheet 18, the piercing edges 52 of each of the stripper bushings 46 engage the wallboard sheet 18 to pre-cut the face paper layer on the top surface of the wallboard sheet. Also, the post 92 of the biasing member 86 engages the stripper plate 42, causing the post to retract or push upwardly into the housing 88 against the biasing force of the coil spring 90 in the housing 88. As such, the biasing member 86 applies a downward biasing force or pressure on the stripper plate 42 to maintain the position of the stripper plate during a punching operation. Simultaneously, the punches 84 move through the respective through-holes 68 and the heads 80 of the bolts 70 move upwardly within the recesses 76 in the upper member 38. Initially, the punches 84 move through the pre-cut openings in the upper or top face paper layer on the wallboard sheet 18 to form clean, non-fragmented holes through the face paper layer. The punches 84 continue to move through the wallboard sheet 18 and at least partially move into the respective die bushings 22. The cutting clearance between the outer surfaces of the punches 84 and the inner surfaces of the die bushings 22 are configured to be in the range of 0.0010 inches to 0.0020 inches so that the bottom face paper layer on the bottom surface of the wallboard sheet 18 is cut cleanly. As such, little to no paper fragments are generated as the punches 84 move through the bottom face paper layer. In the illustrated embodiment, the cutting clearance is 0.0015 inches but may be any suitable clearance value.

Referring now to FIG. 1B, after the punched holes 28 are formed in the wallboard sheet 18, the ram 40 moves the upper assembly 16 away from the lower assembly 14 causing the punches 84 to move upwardly through the through-holes 68 and the biasing member 86 to move upwardly away from the stripper plate 42. The biasing force or pressure on the stripper plate 42 is released when the post 92 of the biasing member 86 disengages from the top surface 62 of the stripper plate 42. As the upper assembly 16 moves upwardly away from the lower assembly 14, the heads 80 of the bolts 70 move downwardly within the respective recesses 76 in the upper member 38. When the heads 80 contact the lower or bottom end 82 of the recesses 76, the upper member 38 lifts upwardly on the heads 80 and simultaneously lifts the stripper plate 42 upwardly away from the wallboard sheet 18. After the stripper plate 42 is disengaged from the wallboard sheet 18, the wallboard sheet 18 is moved to a next punch position or is removed from the punch assembly for further processing. The above process is repeated to form holes in the same wallboard sheet 18 or in another wallboard sheet.

The punching assembly and process described above forms one or more pre-cut openings in the face paper layer on a top surface of a wallboard sheet prior to the punching assembly punching or stamping holes through the wallboard sheet so the clean and clear holes are formed in the wallboard sheet. As a result, the holes in the punched wallboard sheet do not include paper fragments protruding into the holes at the top and bottom surfaces of the wallboard sheet. Thus, a punched wallboard sheet is produced that has an enhanced aesthetic appearance and enhanced acoustical damping properties.

While particular embodiments of the present punch assembly and methods of punching a wallboard sheet have been shown and described, it will be appreciated by those skilled in the art that changes and modifications may be made thereto without departing from the invention in its broader aspects and as set forth in the following claims.

What is claimed is:

1. A punch assembly for creating holes in a wallboard sheet, the wallboard sheet having at least one surface with a face paper layer, the punch assembly comprising: a frame having a lower assembly configured to support the wallboard sheet; a plate on an upper frame assembly, the plate being reciprocable relative to the at least one surface of the wallboard sheet, said plate including an upper surface, a bottom surface that faces the wallboard sheet, and at least one bushing hole having an upper end with a recessed portion extending along a longitudinal axis of the plate; at least one stripper bushing being seated in said at least one bushing hole in the plate and removably connected to the plate, said at least one stripper bushing including a top end and a bottom end, a through hole extending from said top end to said bottom end, a flange projecting laterally outwardly from the top end and seated in said recessed portion of said at least one bushing hole, and a piercing edge extending from said bottom end of said at least one stripper bushing and at least partially beyond said plate; a backing plate placed on said at least one stripper bushing and secured to said plate on the upper frame assembly, said backing plate including a through-hole and configured to hold said at least one stripper bushing in said at least one bushing hole; and at least one punch configured to move through the through holes in the at least one stripper bushing and said backing plate, wherein in operation, the plate is moved against the at least one surface of the wallboard sheet so that the piercing edge of the at least one stripper bushing contacts the face paper layer and at least partially cuts the face paper layer prior to the at least one punch moving through the wallboard sheet to form at least one hole in the wallboard sheet.

2. The punch assembly of claim 1, wherein the body has a cylindrical shape.

3. The punch assembly of claim 1, further comprising a die plate on said lower assembly, said die plate being configured for supporting the wallboard sheet.

4. The punch assembly of claim 3, further comprising a plurality of die bushings removably attached to the die plate, wherein the die bushings include through holes that are each configured to receive the at least one punch.

5. The punch assembly of claim 1, wherein the piercing edge is a non-continuous edge.

6. A punch assembly for creating holes in a wallboard sheet, the wallboard sheet having opposing upper and lower face paper layers, comprising: a frame; a die plate including a plurality of die bushings configured for supporting the wallboard sheet, each of the die bushings including a hole; a stripper plate being vertically reciprocable against the upper surface of the wallboard sheet, said stripper plate including an upper surface, a bottom surface that faces the wallboard sheet and a plurality of bushing holes, each of said plurality of bushing holes having an upper end with a recessed portion extending along a longitudinal axis of the stripper plate; a plurality of stripper bushings being seated in said plurality of bushing holes and removably connected to the stripper plate, each of said stripper bushings being non-movably attached to one of said plurality of bushing holes such that said stripper bushings do not move relative to the stripper plate during use, and each of the stripper bushings including a top end, a bottom end, a through hole and a flange projecting laterally from the top end and seated in said recessed portion of one of said plurality of bushing holes, each of said stripper bushings including a piercing edge, said piercing edge extending from said bottom end of each of said plurality of stripper bushings and at least partially beyond said stripper plate; a backing plate placed on said plurality of stripper bushings and secured to said stripper plate, said backing plate including a plurality of through-holes and configured to hold said plurality of stripper bushings in said plurality of bushing holes; a plurality of punches aligned with corresponding through holes in the stripper bushings, the die bushings and the backing plate, and configured for moving through the through holes in the stripper bushings and the die bushings, wherein in operation, the stripper plate is moved against the upper face paper layer of the wallboard sheet so that the piercing edges of each of the stripper bushings contact and at least partially cut the upper face paper layer prior to the punches moving through the through holes in the stripper bushings, the wallboard sheet and at least partially into the holes in the die bushings to respectively form a plurality of holes in the wallboard sheet.

7. The punch assembly of claim 6, further comprising an upper assembly movably attached to the frame and including the stripper plate, wherein the upper assembly is movable between a non-contact position, where the stripper plate is spaced from the wallboard sheet, and a contact position, where the stripper plate is in contact with the wallboard sheet.

8. The punch assembly of claim 7, further comprising at least one biasing device attached to the upper assembly and configured for biasing the stripper plate against the wallboard sheet when the upper assembly is in the contact position.

9. The punch assembly of claim 8, wherein the biasing device includes a housing, a spring enclosed in the housing and a post movably connected to the housing and positioned adjacent to the spring where the spring biases the post outwardly from the housing.

10. The punch assembly of claim 6, wherein the die bushings are removably attached to the die plate.

11. The punch assembly of claim 6, further comprising an upper assembly movably attached to the frame and including an upper member having at least one recess, at least one support attached to the stripper plate at a first end and movably positioned in the at least one recess at a second end, wherein the upper member lifts the stripper plate away from the wallboard sheet when the at least one support is at a bottom end of the at least one recess.

12. The punch assembly of claim 6, wherein the piercing edge is a non-continuous edge.

13. The punch assembly of claim 1, wherein said lower assembly of said frame includes at least one pilot pin extending upwardly from said lower assembly and configured to engage the wallboard sheet to align and position the wallboard sheet on said lower assembly.

14. The punch assembly of claim 6, wherein said frame includes a lower assembly having at least one pilot pin extending upwardly from said lower assembly and configured to engage the wallboard sheet to align and position the wallboard sheet on said lower assembly.

15. The punch assembly of claim 1, wherein the piercing edge has a substantially flat peripheral surface and a tapered surface extending from said flat peripheral surface.

16. The punch assembly of claim 6, wherein the piercing edge has a substantially flat peripheral surface and a tapered surface extending from said flat peripheral surface.

17. The punch assembly of claim 1, wherein a shape of said at least one bushing hole and a across-section of said at least one stripper bushing are exactly the same.

18. The punch assembly of claim 6, wherein a shape of each of said bushing holes and a across-section of each of said stripper bushings are exactly the same.

19. The punch assembly of claim 18, wherein a diameter of said at least one bushing hole is greater than a diameter of said at least one stripper bushing.

20. The punch assembly of claim 6, wherein a diameter of each of said plurality of bushing holes is greater than a diameter of each of said plurality of stripper bushings.

* * * * *